US008858670B2

(12) United States Patent
Stahl et al.

(10) Patent No.: US 8,858,670 B2
(45) **Date of Patent: *Oct. 14, 2014**

(54) FILTER ARRANGEMENT WITH OVERLAPPING TONGUES

(71) Applicant: Carl Freudenberg KG, Weinheim (DE)

(72) Inventors: Ulrich Stahl, Laudenbach (DE); Uwe Felber, Abtsteinach (DE); Marcel Beisel, Rothenberg (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/101,528

(22) Filed: Dec. 10, 2013

(65) Prior Publication Data

US 2014/0157740 A1 Jun. 12, 2014

(30) Foreign Application Priority Data

Dec. 10, 2012 (DE) ..... 10 2012 024 048
Oct. 28, 2013 (DE) ..... 10 2013 017 759

(51) Int. Cl.
*B01D 46/00* (2006.01)
*F02M 35/02* (2006.01)

(52) U.S. Cl.
CPC ..... *F02M 35/0201* (2013.01); *Y10S 55/31* (2013.01)
USPC ..... 55/497; 55/502; 55/DIG. 31

(58) Field of Classification Search
None
See application file for complete search history.

(56) References Cited

U.S. PATENT DOCUMENTS

| | | | | |
|---|---|---|---|---|
| 7,540,897 | B2 * | 6/2009 | Stahl et al. | 55/497 |
| 2005/0039427 | A1 * | 2/2005 | Karlsson | 55/497 |
| 2009/0056293 | A1 * | 3/2009 | Styles | 55/385.3 |
| 2011/0061352 | A1 | 3/2011 | Stahl et al. | |
| 2011/0131938 | A1 | 6/2011 | Stahl et al. | |

FOREIGN PATENT DOCUMENTS

| | | |
|---|---|---|
| DE | 10 2009 041 113 | 3/2011 |
| DE | 10 2009 056 759 | 6/2011 |
| EP | 1 640 055 | 3/2006 |

* cited by examiner

*Primary Examiner* — Duane Smith
*Assistant Examiner* — Phillip Shao
(74) *Attorney, Agent, or Firm* — Grossman, Tucker, Perreault & Pfleger, PLLC

(57) ABSTRACT

A filter arrangement for filtering the supply air of an engine, comprising a filter element with a folded filter medium, whereby the folded filter medium comprises longitudinal folds with fold walls and fold troughs, and a filter housing for receiving the filter element, whereby the filter housing comprises an upper part and a bottom part. A first insertion tongue is arranged on the upper part and a second insertion tongue is arranged on the bottom part, whereby at least one insertion tongue engages in a fold trough and whereby the insertion tongues press a fold wall between themselves is characterized in that, in regard to the problem of improving the sealing concept of the prior art and of preventing the passage of dust from the raw air side to the clean air side with a high degree of reliability, the filter element comprises side strips manufactured from a compressible material that can be compressed to at least 80% of its thickness in the unloaded state.

5 Claims, 3 Drawing Sheets

FILTER ARRANGEMENT WITH OVERLAPPING TONGUES

CROSS REFERENCE TO RELATED APPLICATIONS

This application claims priority to German Patent Application No. 10 2012 024 048.1 filed on Dec. 10, 2012 and German Patent Application No. 10 2013 017 759.6 filed on Oct. 28, 2013, the disclosures of which are incorporated by reference herein in their entirety.

FIELD OF THE INVENTION

The invention relates to a filter arrangement for filtering the supply air of a motor.

BACKGROUND

A filter arrangement is known from EP 1 640 055 A1 in which the filter element is received by a filter housing consisting of an upper part and a bottom part. The filter element separates a raw air side from a clean air side. In this filter arrangement insertion tongues engage in the fold troughs of adjacent folds of the filter element. The engaging of the insertion tongues into the fold troughs should achieve a very low leakage rate of air between the raw air side and the clean air side.

This sealing concept has the disadvantage that the insertion tongues must be coordinated very precisely in their length with the depth of the fold troughs in order to establish a tight contact of the insertion tongues on the filter medium.

SUMMARY

The invention is therefore based on the problem of improving the sealing concept of the prior art and of preventing the passage of dust from the raw air side to the clean air side with very high reliability.

The above problem is solved by a filter arrangement for filtering the supply air of an engine, comprising a filter element with a folded filter medium, whereby the folded filter medium comprises longitudinal folds with fold walls and fold troughs, and a filter housing for receiving the filter element, whereby the filter housing comprises an upper part and a bottom part. A first insertion tongue is arranged on the upper part and a second insertion tongue is arranged on the bottom part, whereby at least one insertion tongue engages in a fold trough and whereby the insertion tongues press a fold wall between themselves, wherein the filter element comprises side strips manufactured from a compressible material that can be compressed to at least 80% of its thickness in the unloaded state.

It was recognized in accordance with the invention that overlapping insertion tongues that are arranged on the raw air side and on the clean air side can surround the two adjacent folds of a filter element and press them between themselves. An individual insertion tongue does not have to be coordinated in a complicated manner with the depth of the particular folder trough into which it extends but rather the compressibility of the filter medium, that preferably consists of bonded fiber fabric, is utilized for pressing a fold wall. The pressing of the fold wall brings about an elevated density.

In addition, the filter element comprises in accordance with the invention side strips manufactured from a compressible material that can be compressed to at least 80% of its thickness but preferably to 30% of its thickness in the unloaded state. To this extent the material can be compressed by at least 20% but preferably by 70% of its thickness in the unloaded state.

The side strips border the bellows formed by fold walls and fold troughs. The side strips keep the fold walls at a defined distance from each other. In this manner a collapsing of the bellows is prevented. Furthermore, the compressible side strips ensure a tight contact of the bellows on inner walls of the filter housing. To this extent the sealing concept of the prior art is improved and the passage of dust from the raw air side to the clean air side is prevented with a high degree of reliability.

Consequently, the initially cited problem is solved.

The previously cited compressibility is determined according to DIN 53885: 1998-12 "Textiles—Determination of the Compressibility of Textiles and of Textile Products".

The filter element could have side strips manufactured from a compressible bonded fiber fabric that can be compressed to at least 80% of its thickness but preferably to 30% of its thickness in the unloaded state. To this extent the bonded fiber fabric can be compressed by at least 20% but preferably by 70% of its thickness in the unloaded state. The use of a bonded fiber fabric ensures a purity of type of the filter element since the side strips as well as the filter medium can be manufactured from the same polymer.

Given this background, several insertion tongues could be arranged on the upper part and/or on the bottom part. Preferably, two insertion tongues are on one of the two structural components and one insertion tongue is arranged on the opposite structural part. As a result, two fold walls limiting a fold trough can be pressed.

It is conceivable that one or more insertion tongues are arranged on the upper part and/or on the bottom part. It is in particular conceivable that several insertion tongues are arranged on the upper part as well as on the bottom part. In this manner a labyrinth seal can be realized.

If a total of only one insertion tongue was to be provided, it could penetrate into a fold trough and press a fold wall against an opposing wall of the filter housing. As a result, a seal would be achieved although only one insertion tongue is used.

The first insertion tongue could have a first edge and the second insertion tongue could have a second edge, whereby the first and the second edge are oriented in parallel and exert a linear pressure on the fold wall. A surprisingly high seal is realized by the linear pressure.

One insertion tongue or several insertion tongues could be provided with a coating. It is quite concretely conceivable that a coating is used that is so soft that the coating enters a sealing contact with the fold wall.

Given this background, it is conceivable that an insertion tongue consists of two components. The first component is harder than the second component. It is quite concretely conceivable that a hard base component is provided with a soft tip, whereby the soft tip rests on the fold wall and enters a sealing contact with the latter.

It is furthermore conceivable that the insertion tongues have a certain geometry that favors a seal. It is quite concretely conceivable that the insertion tongues meet a fold wall under a certain angle of inclination.

At this time the insertion tongues are arranged in such a manner that they are arranged co-linearly with the direction of the air flow. At this time it is quite concretely provided that the insertion tongues meet a plane at an angle of 90° in which the fold tips of the bellows are located.

However, the insertion tongues could also be arranged at angles deviating from 90° against the previously described plane. It is especially conceivable that a first insertion tongue is inclined under a first angle different from 90° and a second angle is inclined against the plane under a second angle different from 90°.

The angle of inclination of the first and of the second insertion tongue could differ from one another. It is concretely conceivable that the angle of inclination is selected in such a manner the insertion tongues receive a fold wall especially firmly or gently between themselves and press it. All angles are conceivable here. It is also conceivable that only a single insertion tongue is used that is inclined at a certain angle.

The filter element could also be inserted into a filter housing without an insertion tongue. For sealing, the filter element is provided on its four sides with a voluminous bonded fiber fabric. The voluminous bonded fiber fabric assumes the task of sealing. As a consequence, no insertion tongues are necessary that engage into the fold troughs.

The fold walls could be manufactured from a compressible bonded fiber fabric that can be compressed to at least 80% of its thickness but preferably to 30% of its thickness in the unloaded state. In order to produce a sufficient seal on the pressed fold wall a compressibility of the fold wall of at least 80% of its initial material thickness in the unloaded state is necessary.

Given this background, a fold wall could have a thickness in the unloaded state of at least 2 mm. This thickness proved to be sufficient for achieving a good seal and a sufficient filter capacity.

The side strips could be received in undercut spaces of the filter housing. This improves the seal of the filter housing since the sealing area of the side strips does not lie directly in the flow.

The filter element could be provided with exposed and/or freed end folds. As a result, the distance of the end folds from the next folds is selected in such a manner that the insertion tongues can engage without problems in the latter. Furthermore, this constructive measure is suitable so that an insertion tongue engages sufficiently deep into a fold trough in order to achieve a linear pressure or surface pressure with an opposite insertion tongue.

The filter element described here seals sufficiently without a polyurethane seal. Therefore, the filter element described here has no polyurethane seal. Under certain circumstances residual traces or slight amounts of polyurethane can be present on the filter element that, however, do not extend over rather large areas of the filter element so that substantially no polyurethane is used. The filter element should be designed to be of an especially pure type. Therefore polyurethane is substantially or completely not used.

Moreover, the UV stability of the filter element is raised. The filter element is resistant to the radiation of ultraviolet rays for a long time period. Almost no ageing phenomena of the sealing elements occur.

Furthermore, the weight of the filter element is reduced since relatively heavy polyurethane sealing elements are not used.

DETAILED DESCRIPTION

Figure 1:
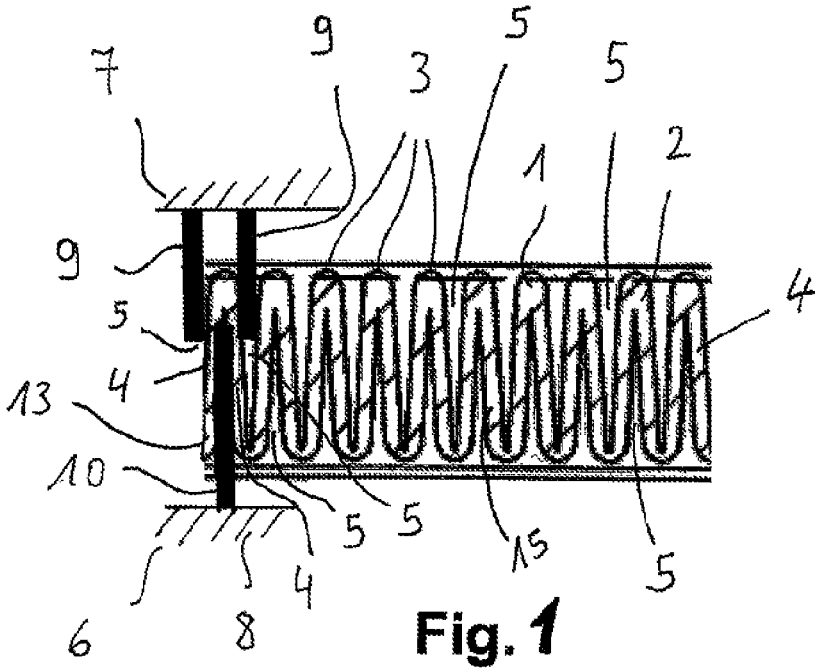
FIG. 1 shows a schematic view of an inside of a filter arrangement comprising overlapping insertion tongues.

FIG. 1 shows an end side of a filter arrangement for filtering the supply air of a motor vehicle engine. This filter arrangement comprises a filter element 1 with a folded filter medium 2, whereby the folded filter medium 2 comprises longitudinal folds 3 with fold walls 4 and fold troughs 5, and a filter housing 6 for receiving the filter element 1, whereby the filter housing 6 comprises an upper part 7 and a bottom part 8. A first insertion tongue 9 is arranged on the upper part 7 and a second insertion tongue 10 is arranged on the bottom part 8, whereby at least one insertion tongue 10 engages in a fold trough 5 and whereby the insertion tongues 9, 10 press a fold wall 4 between themselves.

The filter element 1 comprises side strips 11 manufactured from a compressible bonded fiber fabric that can be compressed to at least 80% of its thickness in the unloaded state.

In the concrete exemplary embodiment according to FIG. 1 two first insertion tongues 9 are arranged on the upper part 7 and a second insertion tongue 10 is arranged on the bottom part 8, whereby two insertion tongues 9, 10 engage into adjacent fold troughs 5 and whereby the insertion tongues 9, 10 press a fold wall 4 between themselves. The pressed fold wall 4 separates the two adjacent fold troughs 5.

Several first insertion tongues 9, namely, two insertion tongues 9 are arranged on the upper part 7. A second insertion tongue 10 on the bottom part 8 engages in an overlapping manner between the first insertion tongues 9 and presses, jointly with the first insertion tongues, two fold walls 4.

The first insertion tongue 9 has a first edge and the second insertion tongue 10 has a second edge, whereby the first and the second edges are oriented in a parallel manner and exert a linear pressure on the fold wall 4.

The fold wall 4 is manufactured from a compressible bonded fiber fabric that can be compressed to at least 80% of its thickness in the unloaded state. The fold wall 4 has a thickness in the unloaded state of at least 2 mm.

Figure 2:
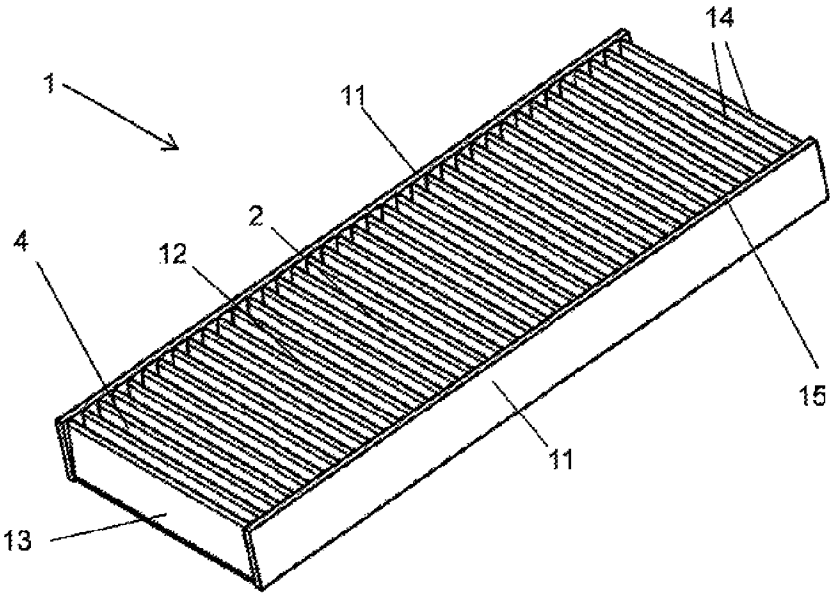
FIG. 2 shows the filter element used in the filter arrangement according to FIG. 1 with compressible side strips.

FIG. 2 shows the filter element 1 used in the filter arrangement according to FIG. 1.

The filter element 1 has side strips 11 that are manufactured from a compressible bonded fiber fabric that can be compressed to at least 80% of its thickness in the unloaded state.

The side strips 11 border the bellows 12 formed by fold walls 4 and fold troughs 5. The side strips 11 keep the fold walls 4 at a defined distance from each other.

In this manner a collapsing of the bellows 12 is prevented. Furthermore, the compressible side strips 11 ensure a tight contact of the bellows 12 on inner walls of the filter housing 6.

FIG. 2 shows that the folded filter medium 2 forms a bellows 12 that comprises side strips 11 on at least two of its sides that are manufactured from a compressible bonded fiber fabric that can be compressed to at least 80% of its thickness in the unloaded state. Here, the side strips 11 are concretely arranged on the two longitudinal sides of a parallelepipedal filter element 1. The side strips 11 are manufactured from a thermoplastic bonded fiber fabric.

The bellows 12 of the filter element 1 is provided with a glue or some other adhesive substance. The filter element 1 is provided with exposed and/or freed end folds 13.

The fold edges 15, that run in a zigzag manner and empty into the longitudinal sides of the bellows 12, are held by the side strips 11 at a constant distance from each other. The fold tips 14 are spaced at a distance from each other.

Figure 3:
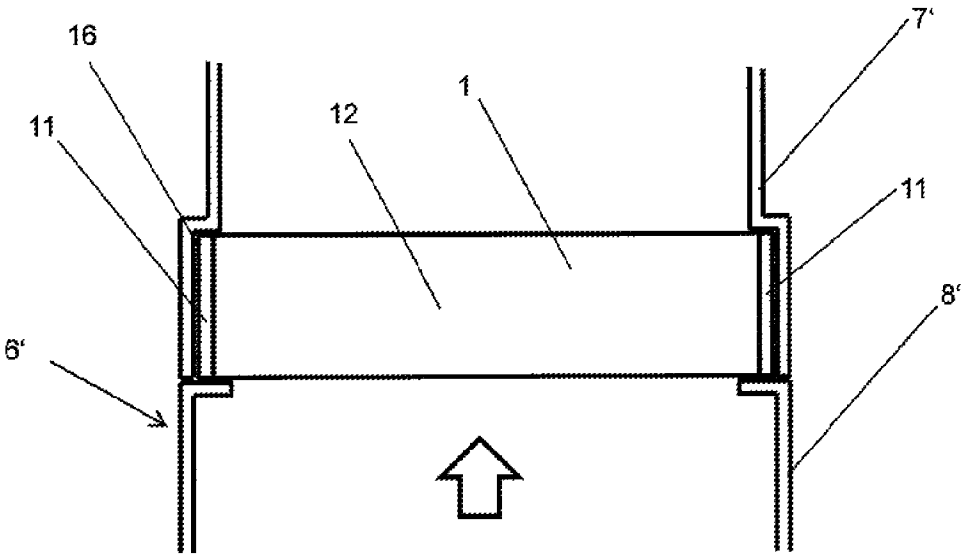
FIG. 3 shows a schematic view of a filter housing that receives side strips in spaces formed by undercuts in the filter housing.

FIG. 3 shows that the side strips 11 are received in undercut spaces 16 of a filter housing 6'. The side strips 11 are received in undercut spaces 16 that are created by undercuts in the filter housing 6'. As a result, the side strips 11 are not located in the flow of the supply air to be cleaned, whose direction of flow is schematically represented by the arrow. The filter housing 6' has an upper part 7' and a bottom part 8'.

What is claimed is:

1. A filter arrangement for filtering the supply air of an engine, comprising a filter element with a folded filter medium, whereby the folded filter medium is a bonded fiber fabric and comprises longitudinal folds with fold walls and fold troughs, the fold walls having a thickness of at least 2 mm, and a filter housing for receiving the filter element, whereby the filter housing comprises an upper part and a bottom part, a first insertion tongue having a first edge is arranged on the upper part and forms an angle with a first fold wall and a second insertion tongue having a second edge is arranged on the bottom part and forms an angle with a second fold wall, wherein the first and second edges of said first insertion tongue and said second insertion tongue extend perpendicularly from said housing upper part and housing lower part and are parallel to one another, whereby the insertion tongues engage in opposite neighboring fold troughs and whereby the first and second edges of the insertion tongues press the first and second fold walls between themselves so as to exert a linear pressure and compress the fabric to at least 30% of its thickness, and wherein the filter element comprises side strips disposed on opposite sides of the filter medium manufactured from a compressible material that can be compressed to at least 80% of its thickness in the unloaded state.

2. The filter arrangement according to claim 1, wherein the filter element comprises side strips manufactured from a compressible bonded fiber fabric that can be compressed to at least 80% of its thickness in the unloaded state.

3. The filter arrangement according to claim 1, wherein several insertion tongues are arranged on the upper part and/or on the bottom part.

4. The filter arrangement according to claim 1, wherein a fold wall is manufactured from a compressible bonded fiber fabric that can be compressed to at least 80% of its thickness the unloaded state.

5. The filter arrangement according to claim 1, wherein the side strips are received in undercut spaces of the filter housing.

* * * * *